US006165003A

United States Patent [19]

Bigotto

[11] Patent Number: 6,165,003

[45] Date of Patent: Dec. 26, 2000

[54] ELECTRICAL CONNECTOR WITH VARIABLE THICKNESS INSULATION-PIERCING CONTACT MEMBER

[75] Inventor: Pier Carlo Bigotto, Rivoli, Italy

[73] Assignee: Framatome Connectors International, France

[21] Appl. No.: 09/196,526

[22] Filed: Nov. 20, 1998

[30] Foreign Application Priority Data

Nov. 21, 1997 [IT] Italy ..... 97/01022

[51] Int. Cl.[7] ..... H01R 4/24; H01R 4/26; H01R 11/20

[52] U.S. Cl. ..... 439/406; 439/395

[58] Field of Search ..... 439/395, 397, 439/399, 400, 401, 406, 407, 387–408

[56] References Cited

U.S. PATENT DOCUMENTS

| | | | |
|---|---|---|---|
| 3,926,498 | 12/1975 | Hoppe, Jr. | 439/400 |
| 3,993,391 | 11/1976 | Vernerey et al. | 439/407 |
| 4,310,212 | 1/1982 | Aujla et al. | 439/403 |
| 5,380,218 | 1/1995 | Yamamoto et al. | 439/397 |

*Primary Examiner*—Brian Sircus
*Assistant Examiner*—Chandrika Prasad
*Attorney, Agent, or Firm*—Perman & Green, LLP

[57] ABSTRACT

An electric terminal (1) having a contact portion (8) which cooperates with a complementary contact element (1'); and a connection portion (6) connectable to an electric cable (7) and having at least one knife element (13) with a pair of facing blades (30) defining an opening (18) for transverse insertion of the cable (7); the blades (30) increasing in thickness from respective and portions (39), for cutting a sheath (12) of the cable (7), to respective base portions (37) cooperating with and for exerting pressure on an inner conductor (11) of the cable.

9 Claims, 3 Drawing Sheets

ELECTRICAL CONNECTOR WITH VARIABLE THICKNESS INSULATION-PIERCING CONTACT MEMBER

FIELD OF THE INVENTION

The present invention relates to an electric terminal for an electric connector.

BACKGROUND OF THE INVENTION

As is known, electric terminals substantially comprise a connection portion for connection to an electric cable, and a contact portion which cooperates, in use, with a complementary contact element, e.g. another electric terminal or a printed circuit board.

Electric terminals are known featuring a so-called IDC (insulation displacement contact) connection portion, i.e. comprising a knife element defining two blades between which the cable is forced transversely to cut the insulating sheath and establish electrical contact with the inner conductor of the cable without having to strip off the end portion of the cable sheath as normally.

The blades must be sufficiently thin (i.e. sharp in the direction of the cable axis to ensure effective cutting of the sheath, and, once the sheath is cut and removed locally, the contact pressure of the blades on the cable conductor must be sufficient to ensure good electrical contact.

If the contact pressure is high and the blades relatively thin, however, the outer strands of the conductor may also be cut, thus reducing the useful section of the conductor.

On the other hand, if the contact pressure is low, contact resistance is undesirably high and inevitably increases even further in use, especially if the terminal is used in an environment subject to vibration and/or aggressive agents, such as automotive electric connectors.

With known terminals, it is extremely difficult to strike a satisfactory compromise between the conflicting requirements of preventing damage to the conductor and achieving good contact pressure, so that terminals of the above type are invariably unreliable and have so far been limited to fairly light-duty applications.

It is an object of the present invention to provide an electric terminal designed to eliminate the aforementioned drawbacks typically associated with known terminals.

According to the present invention, there is provided an electric terminal as claimed in claim 1.

A preferred, non-limiting embodiment of the present invention will be described by way of example with reference to the accompanying drawings, in which:

DETAILED DESCRIPTION OF THE PRESENT INVENTION

Figure 1:
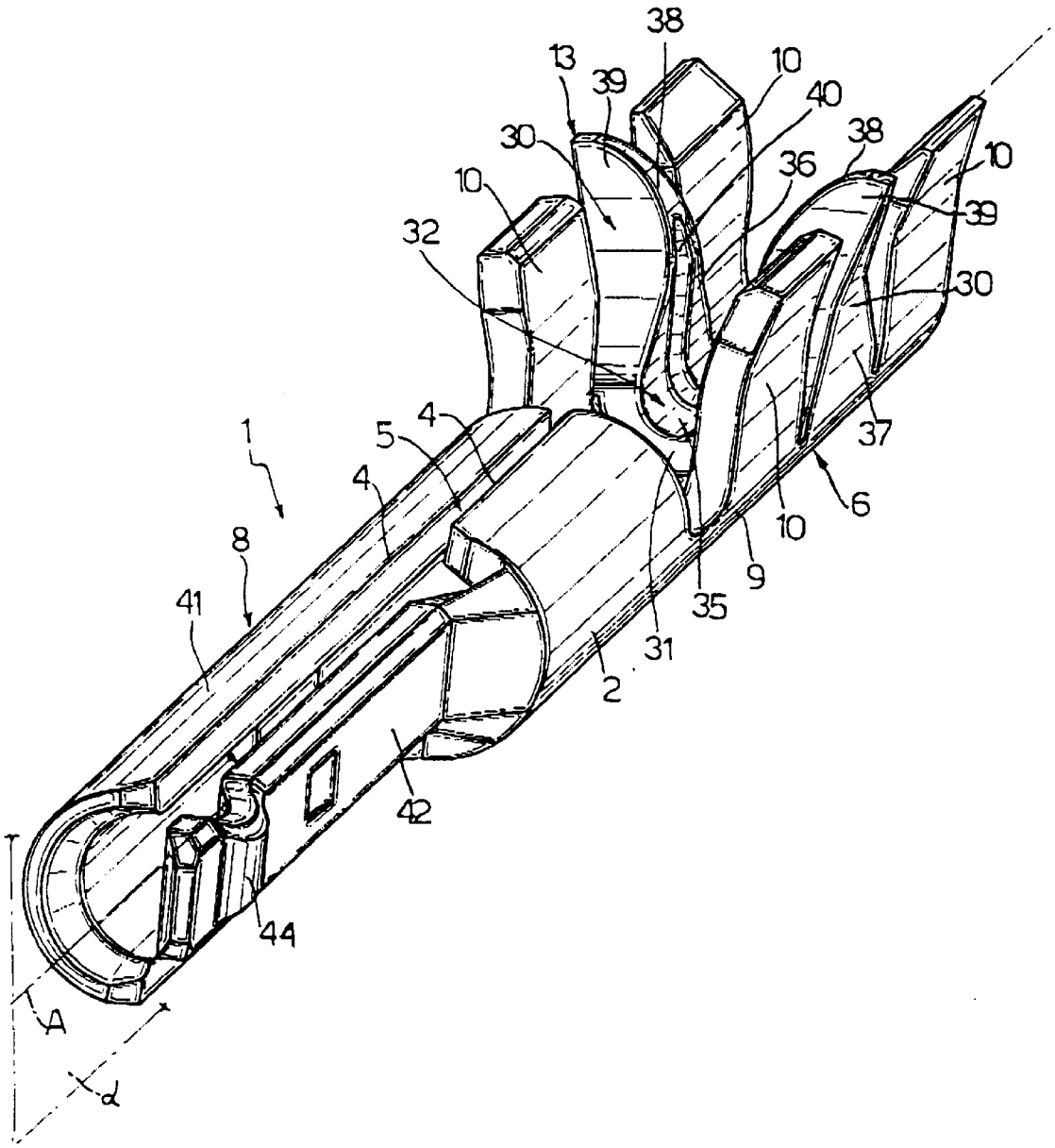
FIG. 1 shows a view in perspective of an electric terminal in accordance with the teachings of the present invention.
Figure 2:
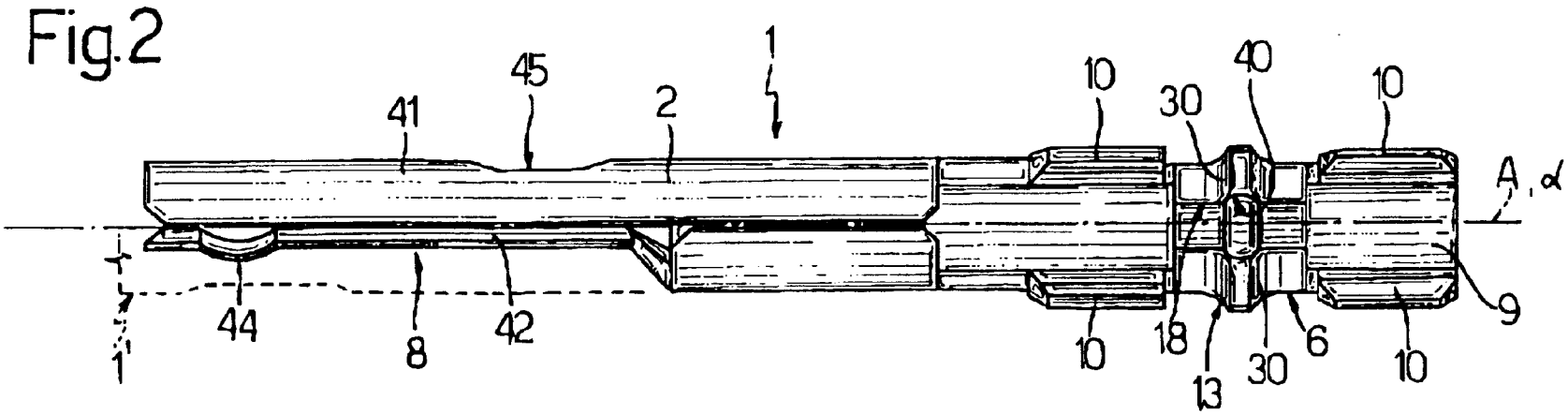
FIG. 2 shows a plan view of the FIG. 1 terminal.
Figure 3:
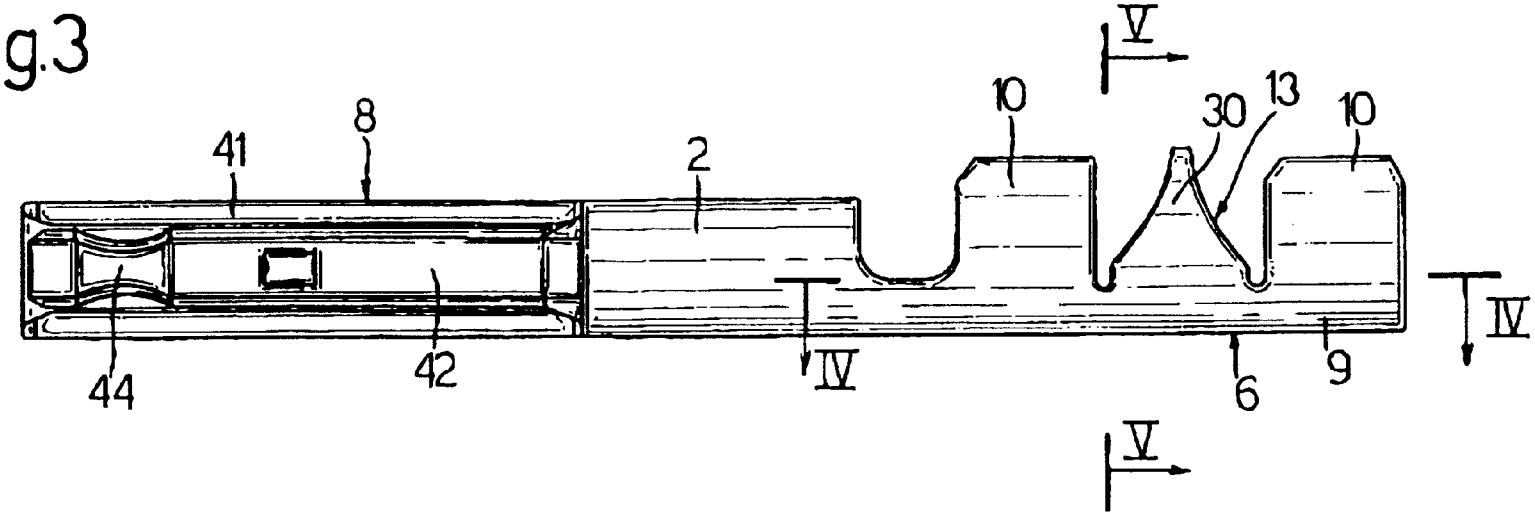
FIG. 3 shows a side view of the FIG. 1 terminal.

With reference to FIG. 1 to 3, number 1 indicates as a whole a hermaphroditic electric terminal for an electric connector (not shown). Terminal 1 is formed in one piece from conductive sheet metal by means of blanking and pressing operations.

Terminal 1 is elongated along a respective axis A defining, in use, the connection direction of the terminal, and comprises, integrally, a substantially cylindrical intermediate portion 2 of axis A, a connection portion 6 for connection to an electric cable 7 (FIG. 4), and a contact portion 8 which cooperates, in use, with the contact portion of an identical electric terminal shown partly by the dash line and indicated 1' in FIG. 2.

Intermediate portion 2 is defined by a wall formed into a cylinder so that adjacent opposite longitudinal edges 4 of the wall form a narrow gap 5.

Connection portion 6 and contact portion 8 extend axially from opposite ends of intermediate portion 2.

More specifically, connection portion 6 comprises a substantially semicylindrical bottom wall 9 of axis A, which axially prolongs a sector of intermediate portion 2 on the opposite side to gap 5.

Connection portion 6 is symmetrical with respect to a mid plane $\alpha$ containing axis A and extending along gap 5, and is open on the same side as gap 5.

Connection portion 6 comprises pairs of tabs 10 extending substantially tangentially from respective opposite longitudinal edges of bottom wall 9, and which are permanently deformable to grip cable 7.

Figure 4:
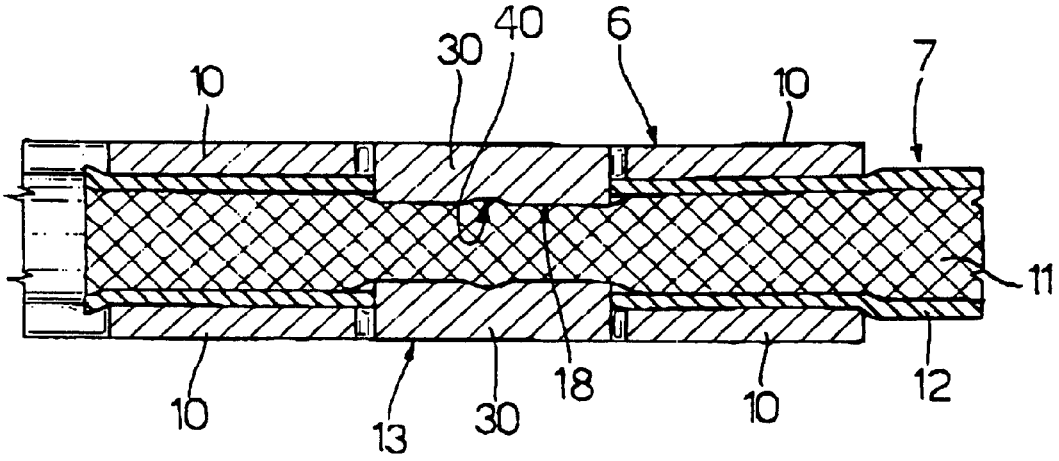
FIG. 4 shows a partial section of the terminal, as connected to a respective electric cable, along line IV—IV in FIG. 3.

Cable 7 comprises, in known manner, an inner conductor 11 defined by a number of strands (not shown); and an outer insulating sheath 12 (FIG. 4).

The connection portion is a so-called IDC (insulation displacement contact) type, and comprises, integrally, a substantially U-shaped knife element 13 symmetrical with respect to plane $\alpha$, interposed axially between pairs of tabs 10, and defining an opening 18 facing the concavity of bottom wall 9.

Knife element 13 comprises a pair of blades 30 facing each other and laterally defining opening 18 (see FIG. 2); and a substantially semicylindrical bottom portion 31 connecting blades 30 so as to form a continuous inner surface 32 of knife element 13.

Figure 5:
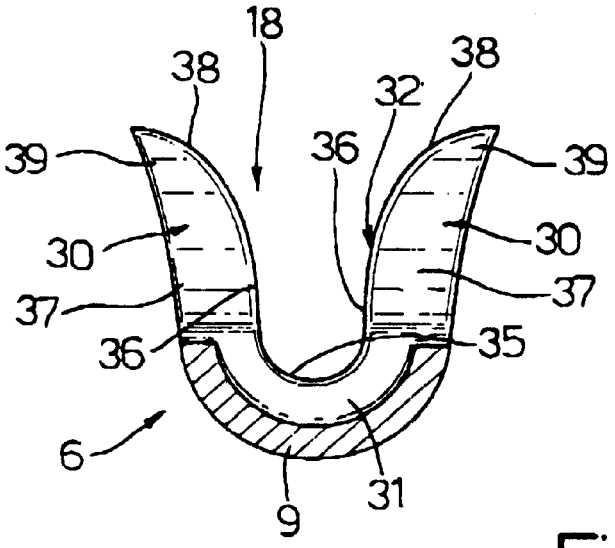
FIG. 5 shows a section along line V—V in FIG. 3.

Element 13 (FIG. 5) has an outer edge substantially coincident with that defined by bottom wall 9 and tabs 10, but blades 30 and bottom portion 31 of knife element 13 are of a width (crosswise to cable 7) greater than the thickness of bottom wall 9 and tabs 10, so that element 13 defines an inner projection, defined by surface 32, of connection portion 6.

More specifically, surface 32 comprises a bottom portion 35 defined by bottom portion 31; two lateral portions 36 (FIG. 5) parallel to each other and to plane $\alpha$ and defined by respective base portions 37 of blades 30; and two lead-in portions 38 connected to respective lateral portions 36 and defined by respective free ends 39 of blades 30. Portions 38 have respective curved convex edges, and converge inwards of knife element 13 to form a lead-in portion of opening 18.

According to the present invention, the thickness (measured parallel to axis A) of blades 30 increases from respective free ends 39 towards bottom portion 31.

More specifically, blades 30 are narrowest at portions 38 of surface 32, which therefore act as cutting edge and interact with sheath 12 of cable 7 when this is inserted inside opening 18; and the width of blades 30 increases gradually (FIG. 3), and more than linearly, along respective base portions 37.

The distance between portions 36 of surface 32 is conveniently smaller than the diameter of conductor 11 of cable 7.

Knife element 13 comprises an inner groove 40 (FIGS. 1 and 2) extending along inner surface 32, substantially in a mid transverse plane of element 13, and along lateral portions 36 and bottom portion 35 of surface 32.

Contact portion 8, not forming part of the present invention, is not described in detail.

Very briefly, portion 8 comprises a semicylindrical contact element 41 extending axially from intermediate portion 2; and a substantially flat contact blade 42 extending axially from intermediate portion 2, along a plane parallel to plane α, and facing the concavity of contact element 41.

Blade 42 comprises a boss 44 projecting away from contact element 41 to define a first contact point of terminal 1; and, close to intermediate portion 2, contact element 41 comprises an impression 45 projecting inwards of terminal 1 to define a second contact point of terminal 1.

Boss 44 and impression 45 cooperate respectively, in use, with impression 45 and boss 44 of terminal 1'.

Terminal 1, in particular connection portion 6 of the terminal, operates as follows.

Cable 7 is inserted inside portion 6 and forced through opening 18 of knife element 13.

To begin with, portions 38 of inner surface 32 of knife element 13 cut the sheath; and, as cable 7 is pressed down to the bottom, sheath 12 is displaced axially up— and downstream from knife element 13, and conductor 11 is forced into element 13 (FIG. 4). On account of the gradually increasing thickness of blades 30, the strands of conductor 11 remain undamaged; and the distance between portions 36 of surface 32, defining the minimum transverse span of opening 18, may therefore be considerably smaller than the diameter of the conductor to achieve a high contact pressure, and hence a low-resistance electric connection, despite the extension contact area.

Conductor 11 adheres to surface 32, and in particular to groove 40, so as to anchor cable 7 axially inside connection portion 6.

Once cable 7 is fully inserted, tabs 10 are pinched onto sheath 12 to secure the cable mechanically inside connection portion 6.

The advantages of terminal 1 according to the teachings of the present invention will be clear from the foregoing description.

In particular, by increasing in thickness, blades 30 provide for effectively cutting sheath 12 but without damaging conductor 11, so that the transverse span of knife element 13 may be such as to exert considerable force on conductor 11 and so achieve a high contact pressure.

Clearly, changes may be made to terminal 1 as described and illustrated herein without, however, departing from the scope of the present invention.

In particular, contact portion 8 may be of any other type, in particular other than hermaphroditic. For example, contact portion 8 may be a male blade or cylindrical pin type, or a female type. Also, connection portion 6 may comprise two or more knife elements 13.

What is claimed is:

1. An electric terminal (1) comprising a contact portion (8) which cooperates with a complementary contact element (1'); and a connection portion (6) which is connected an electric cable (7) and in turn comprises at least one knife element (13) having a pair of facing blades (30) defining an opening (18) for transverse insertion of said cable (7) and an inner surface (32); characterized in that said blades (30) increase in thickness from respective end portion (39), for cutting sheath (12) of said cable (7), to respective base portions (37), for cooperating with and exerting pressure on an inner conductor (11) of the cable said inner surface (32) of said knife element (13) comprises a substantially semicylindrical bottom portion (35); intermediate lateral portions (36) substantially opposed and facing each other, defined by said base portions (37) of said blades (30), and in turn defining said minimum transverse span of said opening (18) of said knife element (13); and lead-in portions (32) defined by said end portions (39) of said blades (30); said lead-in portions (38) being connected to respective intermediate lateral portions (36), and converging with each other inwards of said knife element (13).

2. A terminal as claimed in claim 1, characterized in that said opening (18) has a minimum transverse span smaller than the diameter of said conductor (11).

3. A terminal as claimed in claim 2, characterized in that said knife element (13) comprises a bottom portion (31) connecting said blades (30) and forming with the blades a continuous inner surface (32) raised with respect to a remaining portion (9) of said connection portion (6).

4. A terminal as claimed in claim 3, characterized in that said knife element (13) comprises a groove (40) extending along said inner surface (32).

5. An electrical terminal (1) comprising a contact portion (8) which cooperates with a complementary contact element (1'); and a connection portion (6) which is connected to an electric cable (7) and in turn comprises at least one knife element (13) having a pair of facing blades (30) defining an opening (18) for transverse insertion of said cable (7); characterized in that said blades (30) increase in thickness from respective end portions (39), for cutting a sheath (12) of said cable (7), to respective base portions (37), for cooperating with and exerting pressure on an inner conductor (11) of the cable and a groove (40) extending along an inner surface (32).

6. A terminal as claimed in claim 5, characterized in that said opening (18) has a minimum transverse span smaller than the diameter of said conductor (11).

7. A terminal as claimed in claim 6, characterized in that said knife element (13) comprises a bottom portion (31) connecting said blades (30) and forming with the blades a continuous inner surface (32) raised with respect to a remaining portion (9) of said connection portion (6).

8. A terminal as claimed in any one of the foregoing claims, characterized in that said inner surface (32) of said knife element (13) comprises a substantially semicylindrical bottom portion (35); intermediate lateral portions (36) substantially opposed and facing each other, defined by said base portions (37) of said blades (30), and in turn defining said minimum transverse span of said opening (18) of said knife element (13); and lead-in portions (38) defined by said end portions (39) of said blades (30); said lead-in portion (38) being connected to respective intermediate lateral portions (36), and converging with each other inwards of said knife element (13).

9. A knife element (13) secured to an electric terminal comprising a pair of blade members (30) between which a cable (7) is forced transversely to cut insulating sheath material (12) on said cable (7) and thereby establish electrical contact between said terminal and said cable, said pair of members (30) facing each other and laterally defining an opening (18); a semicylindrically shaped bottom portion (35) connecting said pair of blade members (3) thereby forming a continuos inner surface (32) of said knife element (13), each of said blade members (30) being narrowest in cross section at their top portions (39) and adapted to act as a cutting edge (38) of said insulating sheath (12), the cross-sectional width of each of said blades (30) increasing greater than linearly towards the lower end portions (37) thereof, said knife element further including a groove (40) extending along said inner surface (32).

* * * * *